US009064478B1

(12) United States Patent
Shir

(10) Patent No.: US 9,064,478 B1
(45) Date of Patent: Jun. 23, 2015

(54) PIANO KEY SYSTEM

(71) Applicant: Gregory Shir, Los Angeles, CA (US)

(72) Inventor: Gregory Shir, Los Angeles, CA (US)

( * ) Notice: Subject to any disclaimer, the term of this patent is extended or adjusted under 35 U.S.C. 154(b) by 0 days.

(21) Appl. No.: 14/494,485

(22) Filed: Sep. 23, 2014

Related U.S. Application Data

(63) Continuation-in-part of application No. 13/966,199, filed on Aug. 13, 2013, now Pat. No. 8,841,532.

(60) Provisional application No. 61/742,605, filed on Aug. 15, 2012.

(51) Int. Cl.
*G10C 3/12* (2006.01)

(52) U.S. Cl.
CPC ..... *G10C 3/12* (2013.01)

(58) Field of Classification Search
CPC ..... G10C 3/12
See application file for complete search history.

(56) References Cited

U.S. PATENT DOCUMENTS

| | | | | | |
|---|---|---|---|---|---|
| 2,542,532 | A | * | 2/1951 | Jewett et al. | 84/424 |
| 3,422,720 | A | * | 1/1969 | Johnson | 84/435 |
| 3,715,950 | A | * | 2/1973 | Nordquist | 84/433 |
| 4,628,792 | A | * | 12/1986 | Keast | 84/451 |
| 4,756,225 | A | * | 7/1988 | Carlsson et al. | 84/434 |
| 4,782,734 | A | * | 11/1988 | Rose | 84/423 R |
| 8,841,532 | B2 | | 9/2014 | Shir | |

FOREIGN PATENT DOCUMENTS

CN 103123616 A * 5/2013

OTHER PUBLICATIONS

Shir, Gregory; "New Mozart Piano Aims to Revolutionize Piano Industry"; Overture; Dec. 2011; 1 pg.
PaganiniTechnique.com flyer, "Revolutionary Breakthrough for the Piano Industry!"; Oct. 2011; 1 pg.
Steinbuhler, David; "Our Research"; http://steinbuhlercom/html/our_research.html; 2013; 3 pgs.

* cited by examiner

*Primary Examiner* — Robert W Horn
(74) *Attorney, Agent, or Firm* — Michael Fedrick; Loza & Loza, LLP

(57) ABSTRACT

A keyboard instrument having keys modified as compared to a standard piano keyboard, in which the central longitudinal axis of the C♯ key extends between the adjoining distal lateral sides of the C and D keys.

16 Claims, 9 Drawing Sheets

PIANO KEY SYSTEM

CROSS-REFERENCE TO RELATED APPLICATIONS

The present application claims the benefit of priority under 35 U.S.C. §120 from U.S. patent application Ser. No. 13/966,199, filed on Aug. 13, 2013, and from U.S. Patent Application No. 61/742,605, filed on Aug. 15, 2012. The disclosures of the foregoing applications are incorporated herein by reference in their entirety.

BACKGROUND

The piano is a musical instrument played by depressing keys laid out sequentially on a keyboard. In traditional pianos, pressing a key causes a felt-covered hammer to strike steel strings and thereby produce a pitched tone. The hammers rebound, allowing the strings to continue vibrating at their resonant frequency, and these vibrations are transmitted through a bridge to a sounding board that amplifies the volume of the sound. In electronic instruments having keyboards, pressing a key results in the playing of a predetermined sound associated with that key by the electronic instrument.

The layout of keys on a piano keyboard has been standardized in order to allow players to more easily play repertoire learned on different instruments. The spacing between the keys of a standard piano has changed little since the $18^{th}$ century.

SUMMARY

Despite modem advances in piano manufacturing over the past 160 years, the pattern of keys on piano keyboards has remained the same. Any student of the piano will attest that piano fingering on standard piano keyboards can sometimes be difficult, and that changes to standard keyboard layouts which make such fingering easier would be welcome. The present key system takes into account the layout of piano keys and the human hand, and facilitates piano fingering by providing a new layout of keys on a keyboard.

The present invention generally comprises a musical instrument having a keyboard (10) comprising keys (15) which preferably span at least two octaves, with each octave including keys for the notes A, A♯, B, C, C♯, D, D♯, E, F, F♯, G, and G♯ in order of ascending pitch. In each octave, proximal playing keys or black keys (40) are provided for the notes C♯, D♯, F♯, G♯, and A♯. Each of the black keys comprises a key top (12) having a proximal side (42), a distal side (44), a left lateral side (46), and a right lateral side (48), in which the right lateral side is parallel to the left lateral side and a longitudinal axis extends between the left lateral side (46) and the right lateral side (48) equidistantly between the left lateral side and the right lateral side. Each octave further includes distal playing keys or "white keys" (20) for the notes A, B, C, D, E, F, and G. Each of the white key comprises a key top (12) having a proximal side (22), a distal side (24), a left lateral side (26), and a right lateral side (28), the distal side (24) of each white key extending longitudinally further than the distal side (44) of each black key. Preferably, the distal side (24) of each white key is 22.5 millimeters in length.

In the present keyboard design, the left lateral sides (26) of the white keys (20) for the notes A, B, D, E, and G each comprise a longitudinally extending proximal portion (32), a laterally extending medial portion (33), and a longitudinally extending distal portion (34). The right lateral sides (28) of the white keys (20) for the notes A, C, D, F, and G similarly each comprise a longitudinally extending proximal portion (36), a laterally extending medial portion (37), and a longitudinally extending distal portion (38). The medial portion (37) of the right lateral side of the C key is the same length as the medial portion (33) of the left lateral side of the D key such that the longitudinal axis of the C♯ key extends between the longitudinally extending distal portion of the right lateral side of the C key and the longitudinally extending distal portion of the left lateral side of the D key. This is similar to the standard relationship between the A and G keys, in which the medial portion (37) of the right lateral side of the G key is the same length as the medial portion (33) of the left lateral side of the A key such that the longitudinal axis (60) of the G♯ key extends between the longitudinally extending distal portion (38) of the right lateral side of the G key and the longitudinally extending distal portion (34) of the left lateral side of the A key. In the present keyboard design, the longitudinal axis (60) of the G♯ key remains centered between the G and A keys, i.e. generally between the right longitudinally extending distal portion (38) and the left longitudinally extending distal portion (34).

The present musical instrument can be a standard piano, in which each of the white keys (20) and black keys (40) are mechanically connected to a hammer, and depressing one of the white keys or black keys causes a hammer to strike a steel string. Alternatively, the musical instrument can produce sound electronically, in which case depressing one of the white keys or black keys results in production of sound by electronic means.

FIGURES

DESCRIPTION

Definitions

Figure 1:
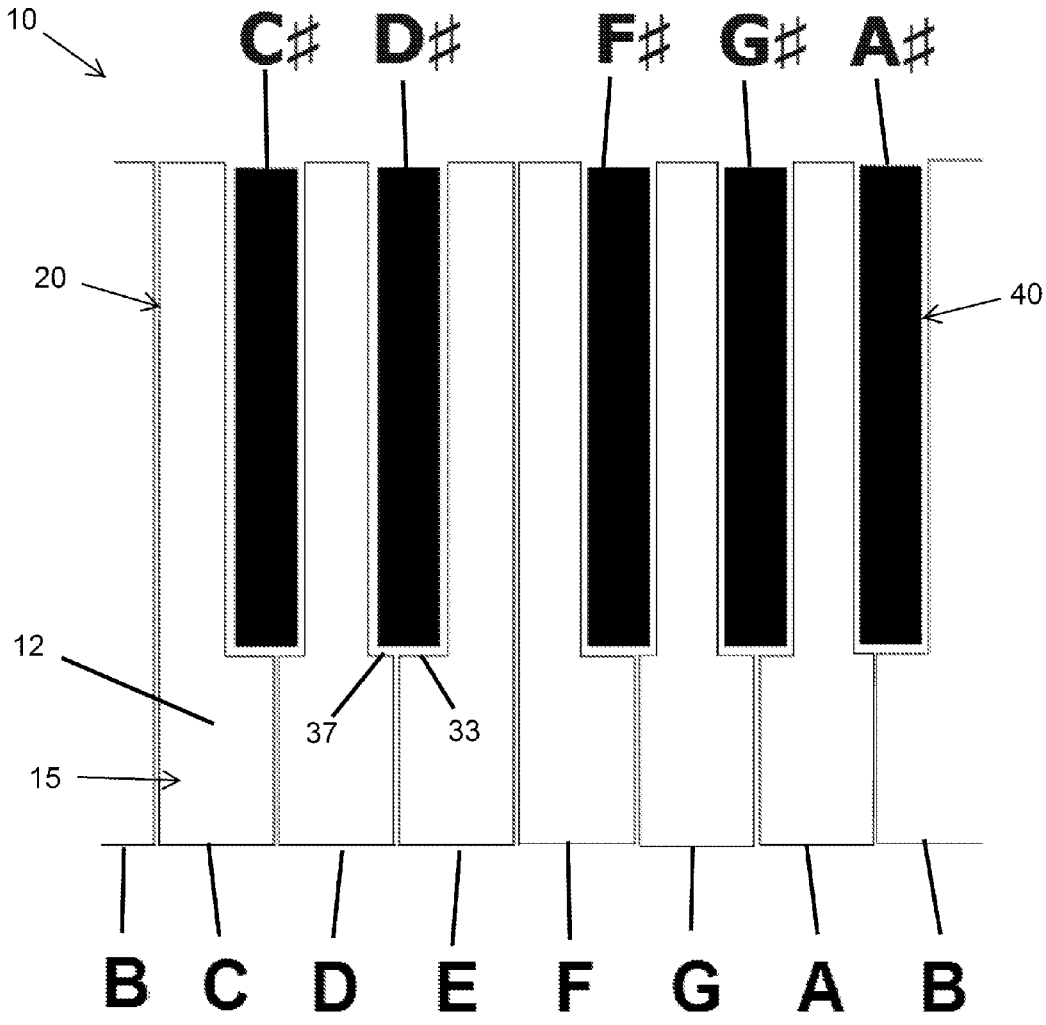
FIG. 1 is a top plan view of keys as laid out on a standard piano.

As used herein, the following terms and variations thereof have the meanings given below, unless a different meaning is clearly intended by the context in which such term is used.

"♯" after a referenced pitch (e.g., A, B, C, etc.) denotes a pitch which is a semitone higher than the referenced pitch, i.e. is "sharp."

"Adjoin" and "adjacent" mean next to. When a black key is said to adjoin another black key, a white key is located between the two black keys.

"Black keys" refer to the proximally positioned keys used to play C♯, D♯, F♯, G♯, and A♯ in a standard piano. Such keys are generally vertically raised with respect to the white keys of a piano, and can also be colors other than black.

"Chromatic scale" refers to a musical scale with twelve pitches, each pitch being a semitone above or below another.

"Edge" refers to a boundary between two surfaces, in particular the boundary between a planar surface and a surface on a different plane or planes. An edge may be radiused or sharp (i.e., non-radiused).

"Face" generally refers to a two-dimensional surface.

"Horizontal" refers to an orientation approximately parallel to (i.e., not substantially extending toward or away from) a support surface on which the present musical instrument is supported when in use.

"Key" refers to a generally longitudinally extending, horizontal actuator of a musical instrument such as a piano which produces sound of a predetermined frequency, pitch, and/or timbre when depressed.

"Keyboard" refers to a set of adjacent depressible keys on a musical instrument, such as a piano.

"Key top" refers to the generally flat, horizontal upper portion of a key. Likewise, "key bottom" refers to the lower portion of a key.

"Octave" generally refers to the twelve pitches (A, A♯, B, C, C♯, D, D♯, E, F, F♯, G, and G♯) of a well-tempered instrument such as a standard piano which span the interval between one musical pitch and another with half or double its frequency.

"Parallel" as used herein refers to a relationship between two straight portions of a key which extend in the same direction but do not substantially diverge or converge. A parallel relationship can include a slight deviation from a parallel orientation, such as an angle of 10° or less toward or away from the parallel portion of the key, preferably 5° or less, more preferably 2° or less.

"Planar" refers to a surface which is generally flat or level, though a planar relationship can include a slight deviation from a level orientation, such as by an angle of 5° or less, preferably by 2° or less, more preferably by 1° or less. Surfaces may be radiused at their edges, e.g. where they join with another surface.

"Standard piano" refers to current full-sized pianos, such as grand pianos and upright pianos.

"Standard piano keyboard layout" and variations thereof refer to the order and arrangement of black and white keys of a standard piano.

"White keys" refer to the keys used to play the pitches A-G (without accidentals) in a standard piano. Such keys can be or comprise other colors. The width of the white keys of the present keyboard is preferably approximately the same, and is also preferably about the same width as is used in standard piano keyboards, i.e. about 22.5 millimeters.

The term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise.

The pitches of the keys are denoted using standard notation, i.e. capitalized letters of the alphabet from A through G, with unsharped keys corresponding to the white keys of a keyboard and sharped keys corresponding to the black keys. It is to be understood that while standard pitches (e.g., the pitch A corresponding to 440 Hz) are preferred, other pitch choices may be used, and as such references to pitches are relative. As used herein, references to the notes C♯, D♯, F♯, G♯, A♯ shall be understood to correspond to D♭, E♭, G♭, A♭, and B♭, respectively, in well-tempered tuning of a standard twelve note octave.

Keyboards

Most modern pianos have 36 black keys and 52 white keys, for a total of 88 keys (seven octaves plus a minor third, from A0 to C8). Many older pianos only have 85 keys (seven octaves from A0 to A7), while some manufacturers extend the range further in one or both directions. The pitch, order, and general arrangement of the keys used in the present system is the same as for a standard piano keyboard, with white keys corresponding to scale pitches from A to G, and black keys corresponding to the scale pitches C♯, D♯, F♯, G♯, A♯ as in a standard piano. As in standard piano keyboards, the distal extent (furthest from the body of a standard piano, but closest to a player of the piano) of the black keys in the present keyboard layout is positioned proximally (further from the player) with respect to the distal extent of the white keys. The upper surface of the black keys is also generally raised (further from a floor or other support surface) with respect to the upper surface of the white keys.

Figure 2:
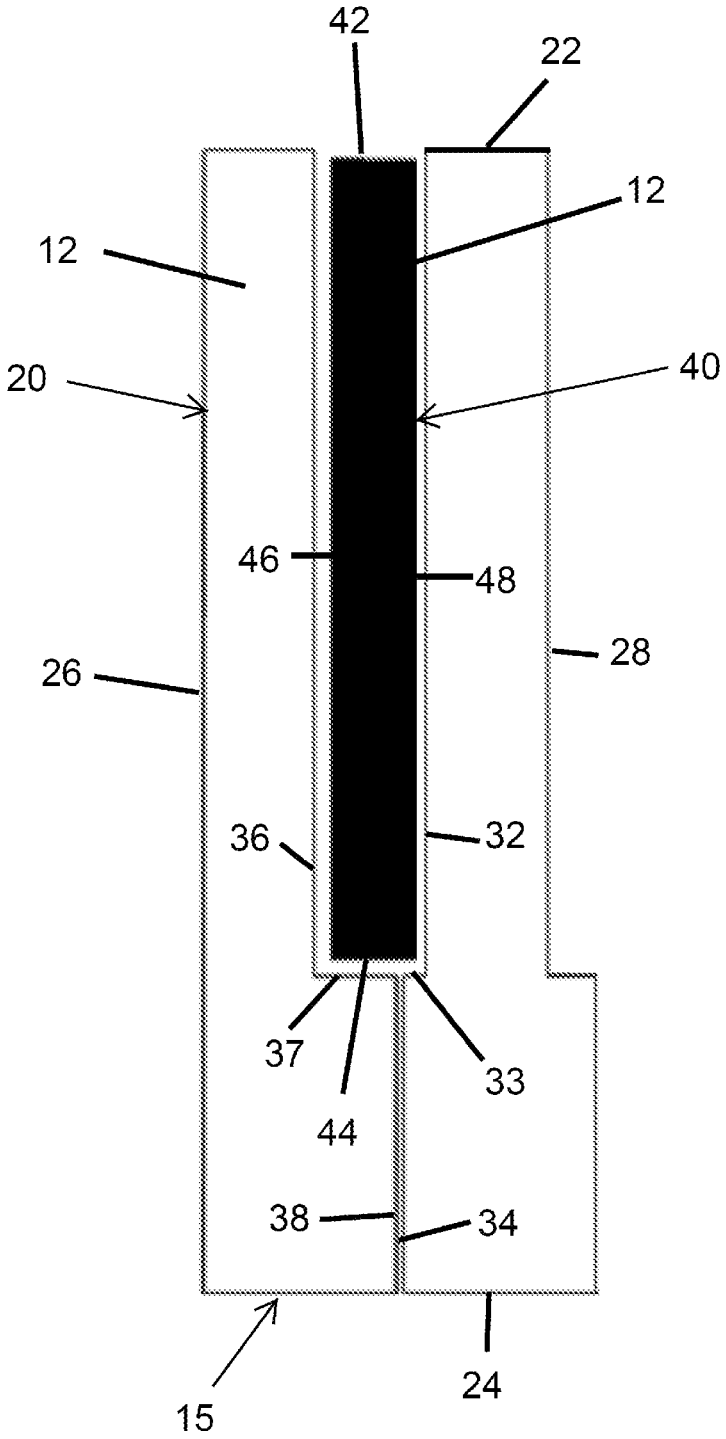
FIG. 2 is a top plan view of keys on a keyboard.
Figure 3:
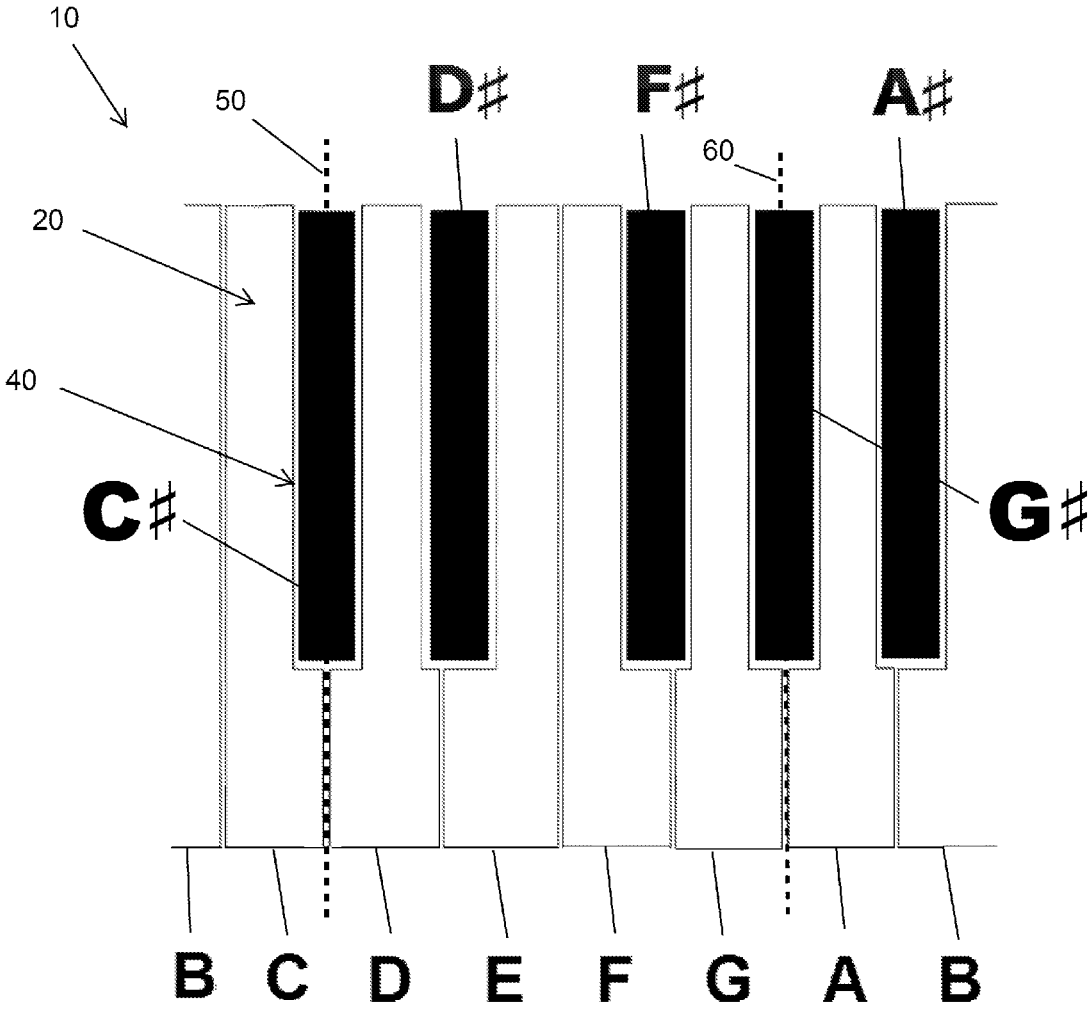
FIG. 3 is a top plan view of the presently disclosed keyboard.
Figure 4:
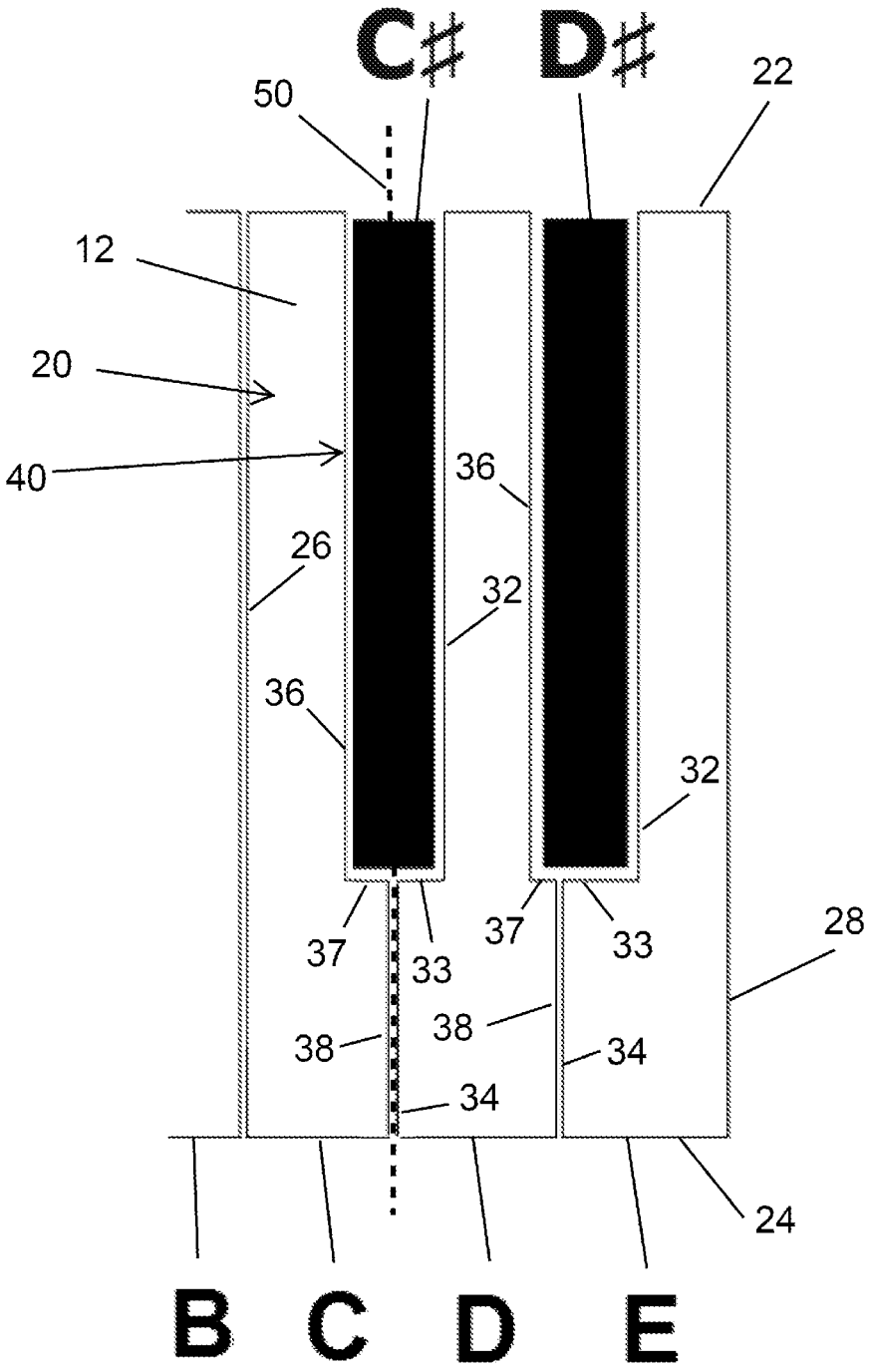
FIG. 4 is a top plan view of a portion of the keyboard of FIG. 3, including the keys C, C♯, D, D♯ and E.
Figure 5:
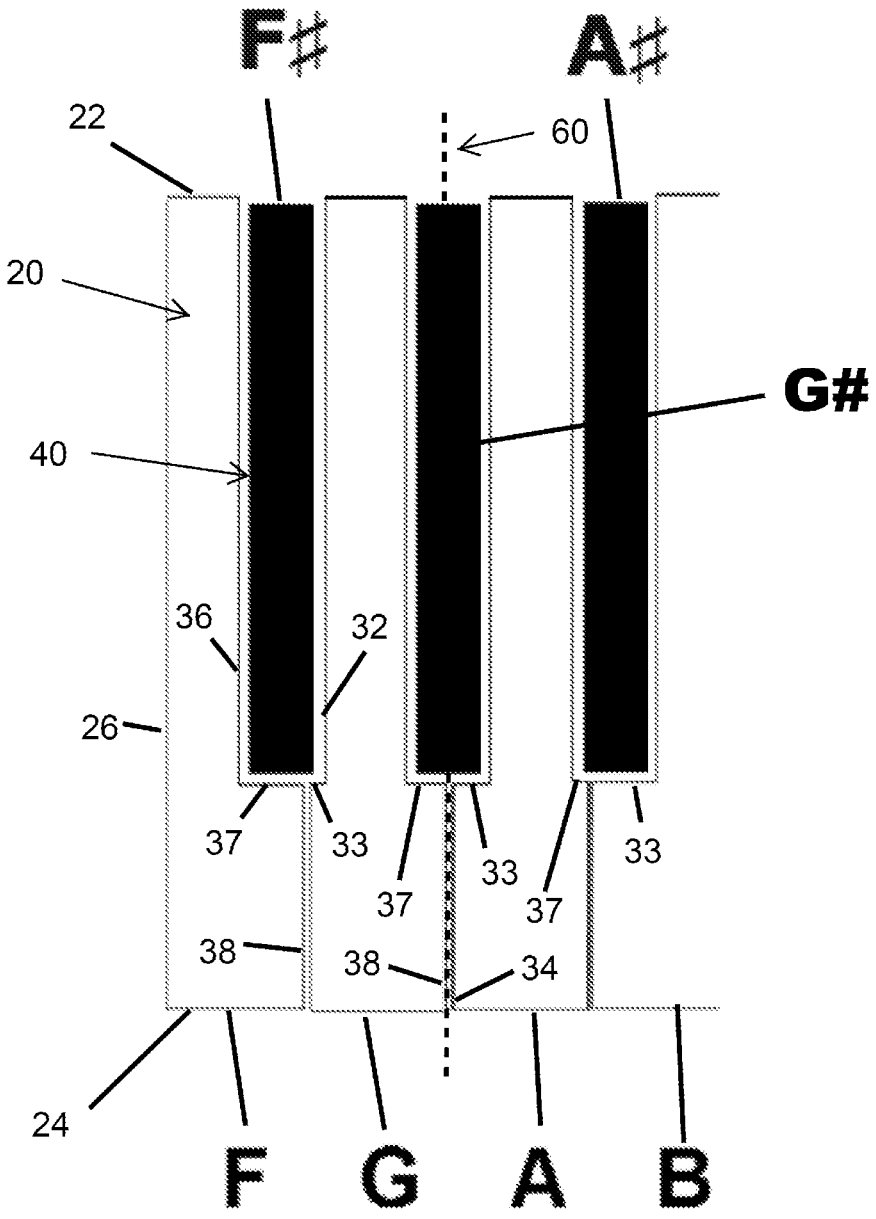
FIG. 5 is a top plan view of another portion of the keyboard of FIG. 3, including the keys F, F♯, G, G♯, A, A♯ and B.
Figure 6:
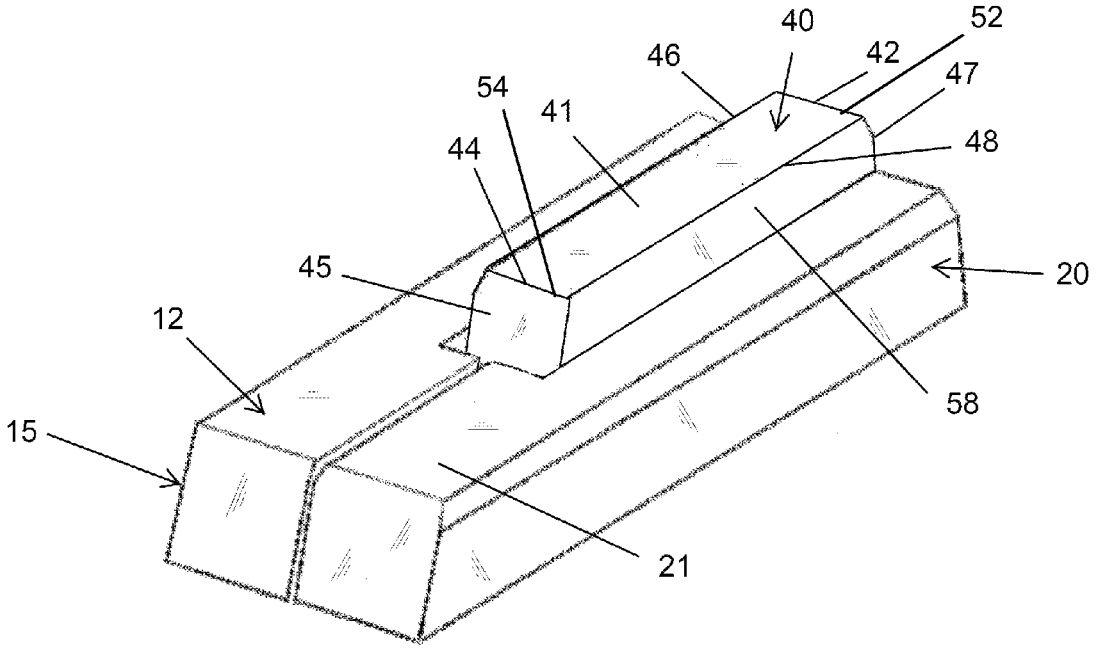
FIG. 6 is a right-side perspective view of keys on a keyboard.
Figure 7:
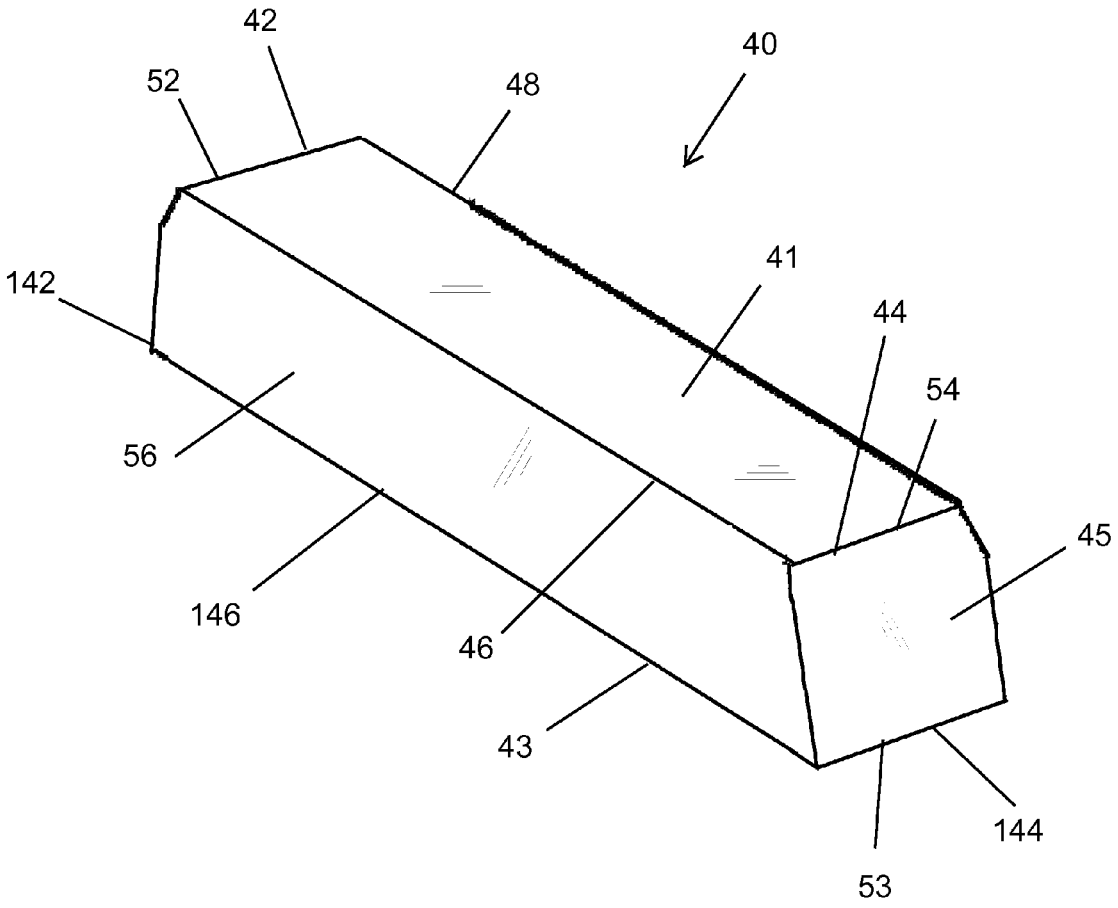
FIG. 7 is a left-side perspective view of a black key.
Figure 8:
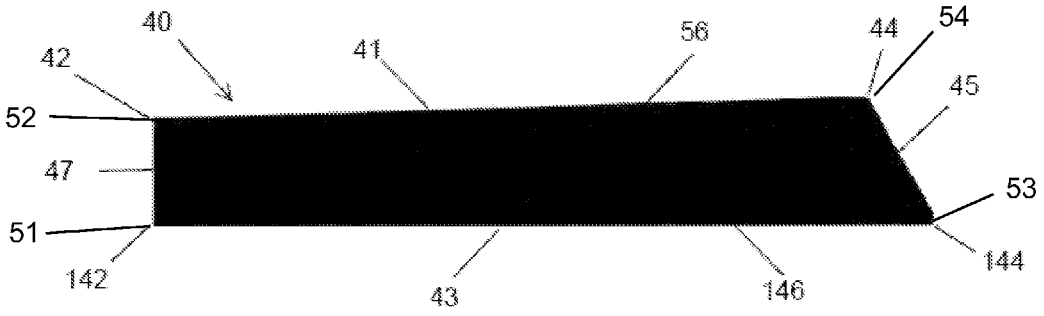
FIG. 8 is a side elevation view of a standard black piano key.

The present invention generally comprises a musical instrument having a keyboard 10 comprising keys 15 which preferably span at least two octaves, with each octave including keys for the notes A, A♯, B, C, C♯, D, D♯, E, F, F♯, G, and G♯ in order of ascending pitch, with each of the foregoing pitches corresponding to a semitone (half step). In each octave, proximal playing keys or "black keys" 40 are provided for the notes C♯, D♯, F♯, G♯, and A♯. As can be seen for example in FIG. 2, each of the black keys 40 comprises a key top 12 (upper surface 49) having a proximal side 42, a distal side 44, a left lateral side 46, and a right lateral side 48, in which the right lateral side 48 is parallel to the left lateral side 46 and a longitudinal axis (such as the longitudinal axes 50 and 60, shown in FIG. 3) extends between the left lateral side 46 and the right lateral side 48 equidistantly between the left lateral side 46 and the right lateral side 48. The proximal side 42 and distal side 44 of each black key 40 are preferably joined to the left lateral side 46 and the right lateral side 48 of the key at approximately right angles. The distal side of the upper surface 41 of the black keys 40 is generally about 11.5 millimeters (11-11.5 mm) long, while the proximal side can be shorter, such as about 9.5 millimeters (9-9.5 mm) in length.

Each octave further includes distal playing keys or "white keys" 20 for the notes A, B, C, D, E, F, and G. Each of the white keys 20 comprises a key top 12 (upper surface 21) having a proximal side 22, a distal side 24, a left lateral side 26, and a right lateral side 28, the distal side 24 of each white key extending longitudinally further than the distal side 44 of each black key. Preferably, the distal side 24 of each white key is 22.5 millimeters in length, and is separated from each adjacent white key 20 by about 1 millimeter. The distal portions of the white keys in the present design, as in standard piano keyboards, are directly adjacent to each other, and are separated by from each other at their distal ends by a space or gap of about 1 millimeter.

In the present keyboard design, the left lateral sides 46 of the white keys 20 for the notes A, B, D, E, and G each comprise a longitudinally extending proximal portion 32, a laterally extending medial portion 33, and a longitudinally extending distal portion 34. The right lateral sides of the white keys 20 for the notes A, C, D, F, and G similarly each comprise a longitudinally extending proximal portion 36, a laterally extending medial portion 37, and a longitudinally extending distal portion 38. As can be seen in FIGS. 2-5, the medial portions 33 and 37 are adjacent to and generally parallel with the distal sides 44 of the proximal keys 40. The medial portions 33 and 37 also preferably join their respective longitudinally extending proximal portions (32, 36) and longitudinally extending distal portions (34, 38) at right angles, as illustrated in the figures.

The left proximal portion 36, left medial portion 37, right medial portion 33, and right proximal portion 32 of adjacent white keys (i.e., the C and D, D and E, F and G, G and A, and A and B keys) together form a space within which respective black keys are positioned. Preferably, a distance of about 1 to 1.25 millimeters, preferably 1.25 millimeters, separates the left lateral side 46 of a proximal playing key (black key) 40 from the right proximal portion 36 of an adjacent white key 20, and likewise the right lateral side 48 of the black key 40 is preferably 1.25 millimeters from the left proximal portion 32 of the adjacent white key 20. The medial portions 33 and 37 of such adjacent white keys 20 are similarly between about 1 to 1.25 millimeters from the distal side 44 of the adjacent proximal key 40.

In standard piano keyboards, the right medial portion 37 of the C key is longer than the left medial portion 33 of the D key (see FIG. 1). In the present keyboard (FIGS. 3 and 4), however, the medial portion 37 of the right lateral side 28 of the C key is the same length as the medial portion 33 of the left lateral side 26 of the D key, such that the longitudinal axis 50 of the C♯ key generally extends between the longitudinally extending distal portion 38 of the right lateral side 28 of the C key and the longitudinally extending distal portion 34 of the left lateral side 26 of the D key. This is similar to the standard relationship between the A and G keys, in which the medial portion 37 of the right lateral side 28 of the G key is the same length as the medial portion 33 of the left lateral side 26 of the A key such that the longitudinal axis 60 of the G♯ key extends between the longitudinally extending distal portion 38 of the right lateral side 28 of the G key and the longitudinally extending distal portion 34 of the left lateral side 26 of the A key. This placement of the C♯ key shifts its longitudinal center leftward (toward the lower-pitched keys and further from the F♯ key) on a keyboard as compared to its placement on a standard piano. Preferably, the medial portion 37 of the right lateral side 28 of the C key and the medial portion 33 of the left lateral side 26 of the D key are each 6.5 millimeters in length, and are separated by a gap of 1 millimeter, thereby forming a space for the C♯ key which is 14 millimeters wide (i.e., 14 millimeters between the right proximal portion 36 of the C key and the left proximal portion 32 of the D key). The medial portion 37 of the right lateral side 28 of the G key and the medial portion 33 of the left lateral side 26 of the A key are likewise preferably each 6.5 millimeters in length, and are separated by a gap of 1 millimeter. The distance between the right proximal portion 36 and the left proximal portion 32 of the C and D keys, D and E keys, the F and G keys, the G and A keys, and the A and B keys, respectively, is likewise preferably 14 millimeters.

In a preferred embodiment, the medial portion 37 of the right lateral side of the D key is 3.25 millimeters in length, and the medial portion 33 of the left lateral side of the E key is 9.75 millimeters in length. The right medial portion 37 of the A key is likewise preferably 3.25 millimeters in length, while the left medial portion of the B key is 9.75 millimeters in length. The medial portion 37 of the right lateral side of the F key is preferably 9.75 millimeters in length, while the medial portion of the left lateral side of the G key is 3.25 millimeters in length. The medial portion of the right lateral sides of the C and G keys is preferably 6.5 millimeters in length, and the medial portion of the left lateral sides of the D and A keys is likewise 6.5 millimeters in length.

The main effect of the foregoing changes is to shift the C♯ key leftward on a keyboard as compared to its placement on a standard piano and to establish more space between the black keys, preferably about 17 millimeters. This makes the keyboard easier to play and improves the experience of an individual playing the piano. In another preferred embodiment, the proximal side of the upper surface of the D, E, F, G, A, and B keys is 12.75 millimeters, while the proximal side of the upper surface of the C key is 16 millimeters, also to facilitate playing the keyboard.

The present keyboard can be used with any of a number of different musical instruments played using a keyboard. This includes all pianos, such as pianos of traditional design (e.g., grand pianos), upright pianos, electric pianos, and toy pianos. The present system can also be applied to other keyboard instruments, including organs, accordions, hurdy-gurdies, and plucked keyboard instruments such as the harpsichord. Electronic instruments such as digital pianos, digital guitars, and synthesizers can also make use of the present keyboard design.

When applied to acoustic pianos (e.g., grand pianos and upright pianos), the present piano fingering system does not substantially alter the structural portions of the piano involved in sound production. Depending on the placement of strings relative to the keys of the present keyboard layout, some mechanical changes may be needed in order to effect the striking of a string by a hammer associated with a particular key. Such mechanical changes are within the skill of one of skill in the art of producing pianos.

Black Key Configuration

As shown in FIGS. 6-10, the black keys 40 each comprise an upper surface 41 having a proximal side 42, a distal side 44, a right lateral side 48, and a left lateral side 46. The lower surface 43 of a black key likewise has a proximal side 142, a distal side 144, a right lateral side, and a left lateral side 146. Black keys 40 further comprise a right lateral face 58 extending between the right lateral side 48 of the upper surface 41 and the right lateral side of the lower surface 43 and a left lateral face 56 extending between the left lateral side 46 of the upper surface 41 and the left lateral side 146 of the lower surface 43. The right lateral face 58 and left lateral face 56 are preferably planar, in order to allow adjacent keys to be depressed without interfering with one another. The upper surface 41 and lower surface 43 are also preferably planar, as in traditional piano designs. Between the upper and lower surfaces of the black keys 40 on their proximal ends, a proximal face 47 extends from an upper edge 52 on the proximal side 42 of the upper surface 41 to a lower edge 51 on the proximal side 142 of the lower surface 43. At the distal end of each black key 40, a distal face 45 extends from an upper edge 54 on the distal side 44 of the upper surface 41 to a lower edge 53 on the distal side 144 of the lower surface 43. The upper edge 54 may be radiused for player comfort.

Figure 9:
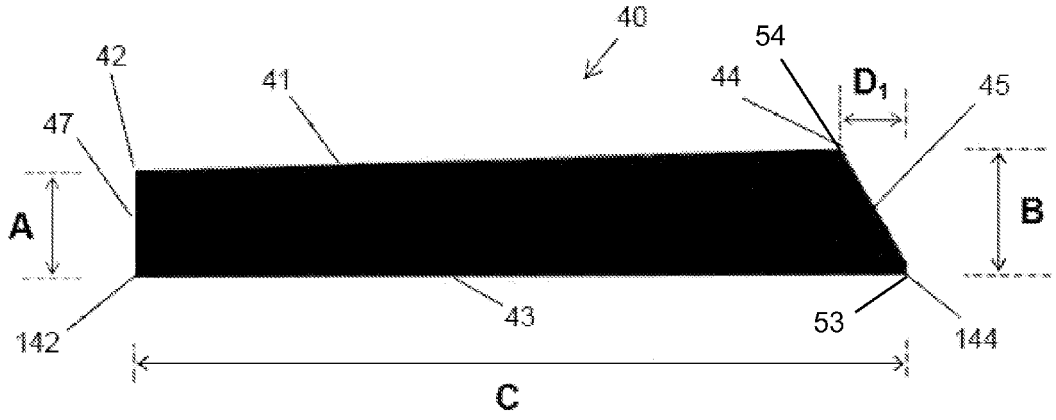
FIG. 9 is a side elevation view of a standard black piano key illustrating the dimensions of the key.
Figure 10:
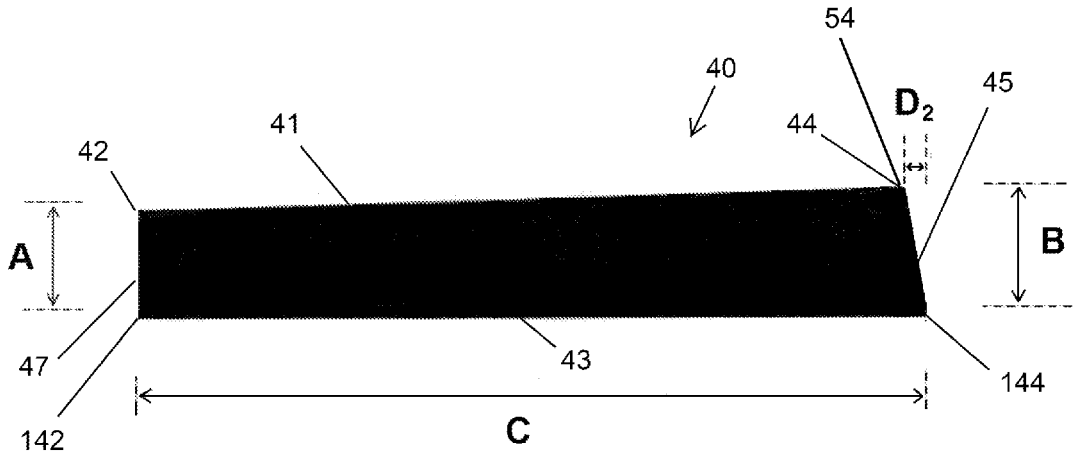
FIG. 10 is a side elevation view of a black piano key according to the present invention.

The black key 40 of a traditional piano is illustrated in FIG. 9, for example, where the distance between the upper edge 52 on the proximal side 42 of the upper surface 41 and the lower edge 51 on the proximal side 142 of the lower surface 43, (illustrated with the letter "A" in FIGS. 9 and 10) is approximately 12.5 millimeters. The distance between the upper edge 54 on the distal side 44 of the upper surface 41 of a traditional black key 40 and the lower edge 53 on the distal side 144 of the lower surface 43 (illustrated with the letter "B" in FIGS. 9 and 10) is generally about 14.5 millimeters. A longitudinal axis (illustrated with the letter "C" in FIGS. 9 and 10) extends from the proximal face 47 to the distal face 45 of each black key 40, and is approximately equidistantly between the right lateral face 58 and the left lateral face 56.

The longitudinal axis C is also preferably parallel to the upper surface 41, and in traditional piano designs also to the lower surface 43.

In standard black keys, the lower surface 43 extends further along the longitudinal axis "C" by approximately 8 millimeters as compared to the upper surface 41, such that the lower edge 53 on the distal side 144 of the lower surface 43 is 8 millimeters further from a predetermined point on the proximal face 47 than the upper edge 54 on the distal side 44 of the upper surface 41. This distance is denoted in FIG. 9 with "D1." In the illustrated embodiment, the lower edge 53 and upper edge 51 are parallel to each other, the proximal face 47 extends upwardly at approximately a right)(90° angle from the lower edge 51, and the lower edge 53 and upper edge 51 are approximately parallel to the proximal face 47, so in this embodiment the lower edge 53 is 8 millimeters further from the proximal face 47 than the upper edge 54. In a preferred embodiment, illustrated in FIG. 10, the lower edge 53 extends further along the longitudinal axis from a predetermined point on the proximal face 47 by only 3 millimeters as compared to the upper surface 41, such that the lower edge 53 is 3 millimeters further from the proximal face 47 than the upper edge 54. This distance is denoted in FIG. 10 with "D2."

By shortening the distance "D1" by 5 millimeters, a player's fingers can more easily reach the distal upper edge of a black key 40 while playing the present keys as compared to standard black keys. This facilitates playing of keyboards which incorporate black keys according to the presently disclosed design. The distance "D2" between the longitudinal extent of the upper edge 54 and the longitudinal extent of the lower edge 53 in this preferred embodiment, i.e. a differential distance of 3 millimeters, results in a distal face 45 having a shape which provides sufficient comfort for players.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure. All references cited herein are incorporated by reference in their entirety.

What is claimed is:

1. A keyboard for a musical instrument comprising a plurality of keys, the keys comprising at least two octaves with each octave including keys for the notes A, A♯, B, C, C♯, D, D♯, E, F, F♯, G, and G♯ in order of ascending pitch, wherein each octave comprises:

black keys for the notes C♯, D♯, F♯, G♯, A♯ in order of ascending pitch, wherein each black key comprises a key top having a proximal side, a distal side, a right lateral side, and a left lateral side, wherein the right lateral side of each black key is parallel to the left lateral side of the black key, and wherein a longitudinal axis extends between the left lateral side and the right lateral side of each black key equidistantly between the left lateral side and the right lateral side; and white keys for the notes A, B, C, D, E, F, and G in order of ascending pitch, wherein each white key comprises a key top having a proximal side, a distal side, a right lateral side, and a left lateral side, the distal side of each white key extending longitudinally further than the distal side of each black key, wherein the left lateral sides of the white keys for the notes A, B, D, E, and G each comprise a longitudinally extending proximal portion, a laterally extending medial portion, and a longitudinally extending distal portion, wherein the right lateral sides of the white keys for the notes A, C, D, F, and G each comprise a longitudinally extending proximal portion, a laterally extending medial portion, and a longitudinally extending distal portion, and wherein the medial portion of the right lateral side of the C key is the same length as the medial portion of the left lateral side of the D key, such that the longitudinal axis of the C♯ key extends between the longitudinally extending distal portion of the right lateral side of the C key and the longitudinally extending distal portion of the left lateral side of the D key.

2. The keyboard of claim 1, wherein the medial portion of the right lateral side of the C key is 6.5 millimeters in length, and the medial portion of the left lateral side of the D key is 6.5 millimeters in length.

3. The keyboard of claim 1, wherein the medial portion of the right lateral side of the D key is 3.25 millimeters in length, and the medial portion of the left lateral side of the E key is 9.75 millimeters in length.

4. The keyboard of claim 1, wherein the medial portion of the right lateral side of the F key is 9.75 millimeters in length, and the medial portion of the left lateral side of the G key is 3.25 millimeters in length.

5. The keyboard of claim 1, wherein the medial portion of the right lateral side of the A key is 6.5 millimeters in length, and the medial portion of the left lateral side of the A key is 6.5 millimeters in length.

6. The keyboard of claim 1, wherein the medial portion of the right lateral side of the A key is 3.25 millimeters in length, and the medial portion of the left lateral side of the B key is 9.75 millimeters in length.

7. The keyboard of claim 1, wherein the distal side of each white key is 22.5 millimeters in length.

8. The keyboard of claim 1, wherein the distal side of the upper surface of each black key is 11.5 millimeters in length and the distal side of the upper surface of each black key is 9.5 millimeters in length.

9. The keyboard of claim 1, wherein the proximal side of the upper surface of the D, E, F, G, A, and B keys is 12.75 millimeters.

10. The keyboard of claim 1, wherein the proximal side of the upper surface of the C key is 16 millimeters.

11. The keyboard of claim 1, wherein the medial portion of the right lateral side of the G key is the same length as the medial portion of the left lateral side of the A key such that the longitudinal axis of the G♯ key extends between the longitudinally extending distal portion of the right lateral side of the G key and the longitudinally extending distal portion of the left lateral side of the A key.

12. The keyboard of claim 1, wherein each of the white keys and black keys are mechanically connected to a hammer, and wherein depressing one of the white keys or black keys causes a hammer to strike a steel string.

13. The keyboard of claim 1, wherein the musical instrument produces sound electronically, and wherein depressing one of the white keys or black keys results in production of sound.

14. The keyboard of claim 1, wherein the keys comprise at least four octaves.

15. A keyboard for a musical instrument comprising a plurality of keys, each key corresponding to a note of a chromatic scale, wherein the keyboard includes keys for the notes A, A♯, B, C, C♯, D, D♯, E, F, F♯, G, and G♯ in order of ascending pitch, wherein each octave of the chromatic scale comprises black keys for the notes C♯, D♯, F♯, G♯, A♯ in order of ascending pitch, and wherein each black key comprises:

an upper surface having a proximal side, a distal side, a right lateral side, and a left lateral side;

a lower surface having a proximal side, a distal side, a right lateral side, and a left lateral side;

a right lateral face extending between the right lateral side of the upper surface and the right lateral side of the lower surface;

a left lateral face extending between the left lateral side of the upper surface and the left lateral side of the lower surface;

a proximal face extending from an upper edge on the proximal side of the upper surface to a lower edge on the proximal side of the lower surface;

a distal face extending from an upper edge on the distal side of the upper surface to a lower edge on the distal side of the lower surface; and a longitudinal axis extending from the proximal face to the distal face, wherein the longitudinal axis extends equidistantly between the right lateral face and the left lateral face and between the upper surface and the lower surface, wherein the lower edge of the distal face extends 3 millimeters further along the longitudinal axis than the upper edge of the distal face.

16. The keyboard of claim 15, wherein the upper edge and lower edge of the distal face are parallel.

* * * * *